United States Patent [19]

Robinson

[11] 4,143,691

[45] Mar. 13, 1979

[54] ROUTER

[76] Inventor: Clayton Robinson, Willow Grove Rd., Stony Point, N.Y. 10980

[21] Appl. No.: 886,308

[22] Filed: Mar. 13, 1978

[51] Int. Cl.[2] ..... B27C 5/10

[52] U.S. Cl. ..... 144/134 D; 33/27 C; 90/12 D; 144/136 C

[58] Field of Search ..... 33/27 C; 90/DIG. 3, 90/12 D; 144/134 R, 134 D, 136 R, 136 C

[56] References Cited

U.S. PATENT DOCUMENTS

| | | | |
|---|---|---|---|
| 3,513,548 | 5/1970 | Itano | 33/27 C |
| 3,635,268 | 1/1972 | Lange | 144/136 C |
| 3,775,853 | 12/1973 | Doret et al. | 33/27 C |
| 4,044,805 | 8/1977 | Gronholz | 144/136 C |

*Primary Examiner*—Othell M. Simpson
*Assistant Examiner*—W. D. Bray
*Attorney, Agent, or Firm*—Wolder, Gross & Yavner

[57] ABSTRACT

A router base plate defines a continuous radial slot through a diameter of its annular shape for receiving a pair of mating slides. The slides define positioning holes which accommodate pilot pins to be forced into the work piece in order to anchor the router for circular cuts, the pilot pin being the center of the circle. In this way, no additional sub-bases or attachments are necessary for use with the router in order to make design cuts therewith.

6 Claims, 14 Drawing Figures

ROUTER

This invention relates primarily to router constructions and more particularly a construction of a router which uses standard router parts to enable design cuts in the form of circles for varying diameter without significant manipulation of the router.

Even in the last century, woodworkers used machines for routing or cutting curves or channels in the surface of material for a variety of purposes. These machines were also used for finishing the surface of a material. Such machines came to be known as routers and to this day remain a primary tool of the woodworkers' art. In recent years, the router has become a base tool to which has been added a number of removable mountings to increase the use capability of the tool. For instance, attached U.S. Pat. No. 3,376,787 (Peter H. Morganson) covered a guide attachment to provide accurate and steady control for straight and circular cuts to be made by a router. The Morganson invention served to accomplish its purpose, but also served to increase the bulk and complexity of the router without providing an anchor for the center point of circles and curves to be made by the tool.

Likewise, attached U.S. Pat. No. 3,635,268 issued to Henry G. Lange, overcame one of the drawbacks of Morganson by providing an attachable sub-base which included both annular and radially extending portions in order to increase the diameter capability for circles to be cut with the router tool. However, Lange continued the Morganson effort in terms of the drawback of complexity and added bulk for the tool. In both Morganson and Lange, a philophosy of increasing complexity and bulk detracted from the ability of the woodworkers to handle a simple and compact tool for the purposes intended. In other words, one of the basic advantages of the router tool is its compact and efficient construction for the purposes intended and any detraction from this advantage works to lessen the value of the router, when compared with hand-working methods for cutting or routing that had been previously used.

Accordingly, a primary object of the present invention is to provide a router whose basic compact design is maintained while providing the capability of anchoring the tool while routing or cutting circles or curves of varying diameter.

A further and more particular object is to provide a router base which is restructured to accommodate means by which the tool is anchored during cutting or routing of varying diameter circles or curves.

Other objects and advantages of the present invention are accomplished in a routing tool or router which features a standard motor housing from which depends a base frame, the bottom of which terminates in an annular base, to which is attached a median plate and a base plate. Other than the base plate, the router is of standard construction which conforms to the form of router represented by the prior art. However, the base plate is made in two parts to form a center groove into which is slidably attached a pair of mating slides, each defining a plurality of positioning pin openings through which is selectively placed a pilot pin. The pilot pin is placed through one of the openings and into the work piece to form the center for a curve or circle to be worked by the router. There are two dimensions of adjustment capability for the size of the curve or circle; namely, the choice of positioning opening through which the pilot pin is placed and the position of one or both slides in the router base groove. The positions of the slides are maintained during use of the router by means of winged set screws which are placed through the router base frame, through the median plate and to the top of the slides. A set screw is provided for each slide so that separate adjustment of the slides is possible.

Other objects, features and advantages of the present invention will become more apparent by means of the following more detailed description of a preferred, but nontheless illustrative, embodiment of the present invention, with reference to the accompanying drawings, wherein.

Figure 1:
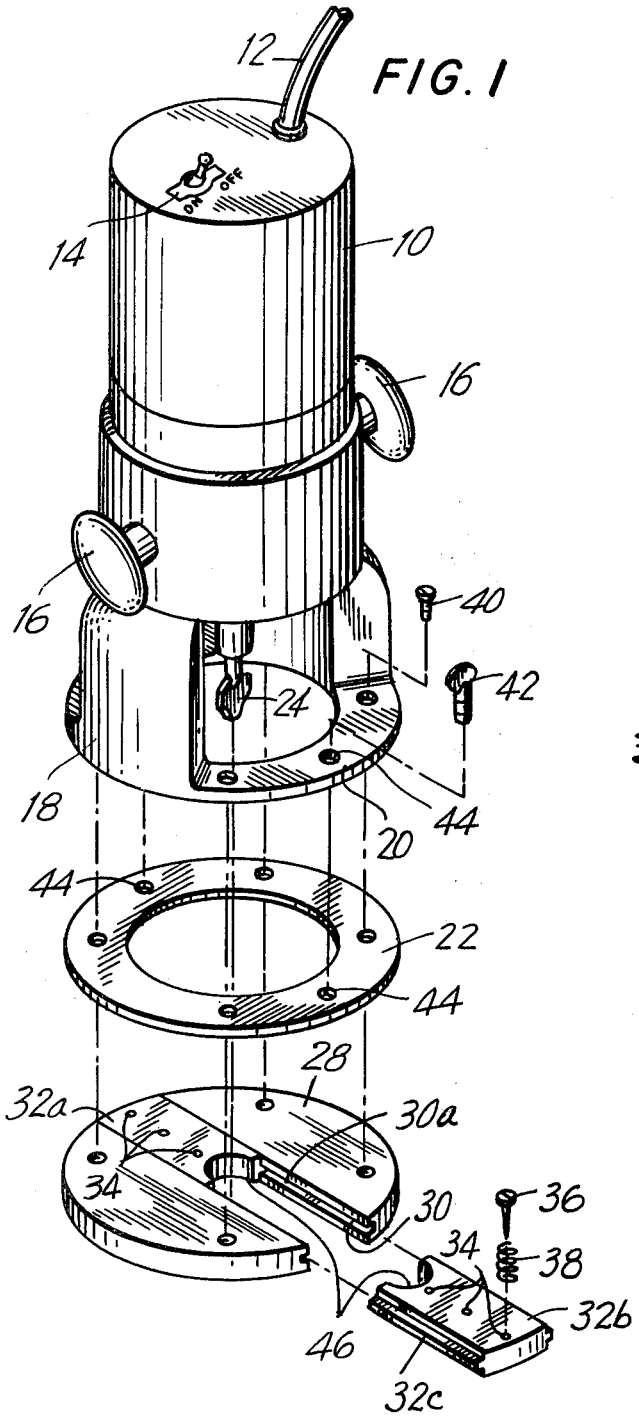
FIG. 1 is an exploded, isometric full view representation of a router tool according to the present invention, showing particularly the attachment of the base plate to the tool and the adjustment capability for the slides thereof.

Referring to the drawings, the router construction comprises a conventional router motor (not shown) housed within motor housing 10. The motor is supplied with power by a conventional power source (not shown) which feeds through wire 12, or the like, upon energization by means of switch 14. Laterally extending from the housing are handles 16 and depending from motor housing 10 is skeletal base frame 18 which terminates at its lower end in an annular base 20. Attached to the annular base 20 is a median plate 22, with all of the aforementioned items being found on standard router assemblies presently available.

Figure 2:
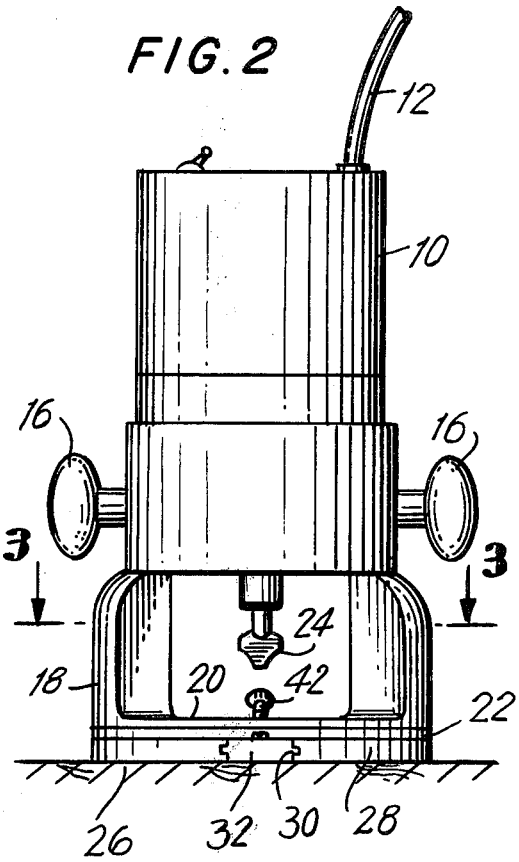
FIG. 2 is a fully assembled, front view representation of a router according to the present invention.

The main purpose of the motor is to drive an axially disposed cutting tool 24 which routes or cuts a work piece 26 (FIG. 2) to take the place of an otherwise hand-operated process for causing a groove, either straight or circular in the work piece.

As with most routers, a base plate 28 is provided, but the construction thereof according to the present invention includes a continuous, radially positioned slot 30 in the base plate to accommodate a pair of mating slies 32*a*, 33*b*. In more detail, the slot 30 defines a keyway 30*a*, and the slides include laterally extending flanges 32*c* for mating, sliding relation with keyway 30*a*. Furthermore, each slide defines a series of positioning openings 34 which are intended to receive a pilot pin 36 which is fitted with a coiled spring 38 in order to complete the engagement of the pin with work piece 26 in a relesable manner, as will be described herein.

It may be seen that screws 40 are inserted through holes defined by the annular base 20, the median plate 22 and the base plate 28 in order to secure the various parts of the router. Furthermore, winged set screws 42 are intended for insertion through screw holes 44 defined in the annular base 20 and the median plate 22 to bear against the slides and hold their position as set by the operator, as shown particularly in FIG. 2.

It may also be seen that the cutting tool is accommodated by the router in line with the axis of the substantially cylindrical motor housing 10. Slides 32*a*, 32*b* are structured to define a central opening 46 through which the cutting tool extends to work piece 26.

Figure 6:
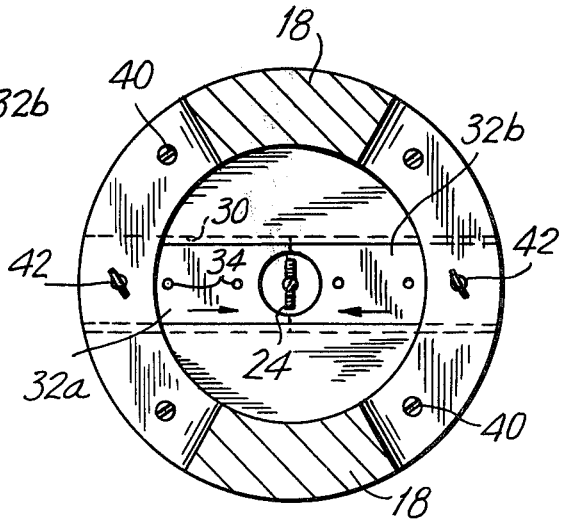
FIG. 6 is a view similar to that of FIG. 3, but showing the slides in fully closed position to illustrate the lack of added bulk caused by the construction of the present invention to the standard router tool.

As shown particularly in FIG. 6, when slides 32*a*, 32*b* are moved to their innermost position, they do not extend beyond the outer boundaries of annular base 20, thereby enabling the basic router design to maintain its compactness and ease of handling for the operator.

Figure 3:
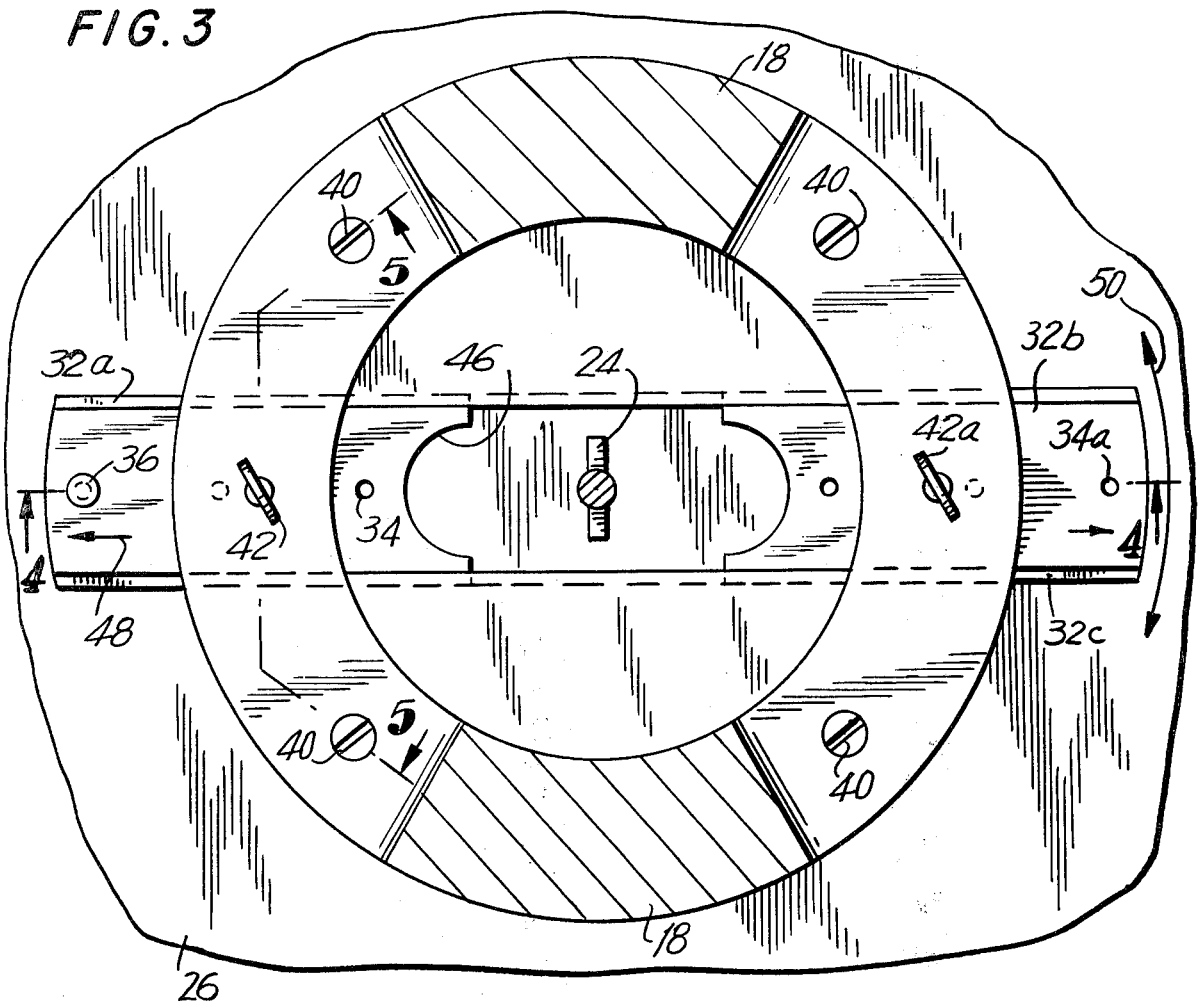
FIG. 3 is a sectional view taken along the line 3—3 of FIG. 2 and showing particularly the motion capability of the adjustable slides of the router base plate and the use of a pilot pin for anchoring the tool during a routing or cutting operation.
Figure 4:
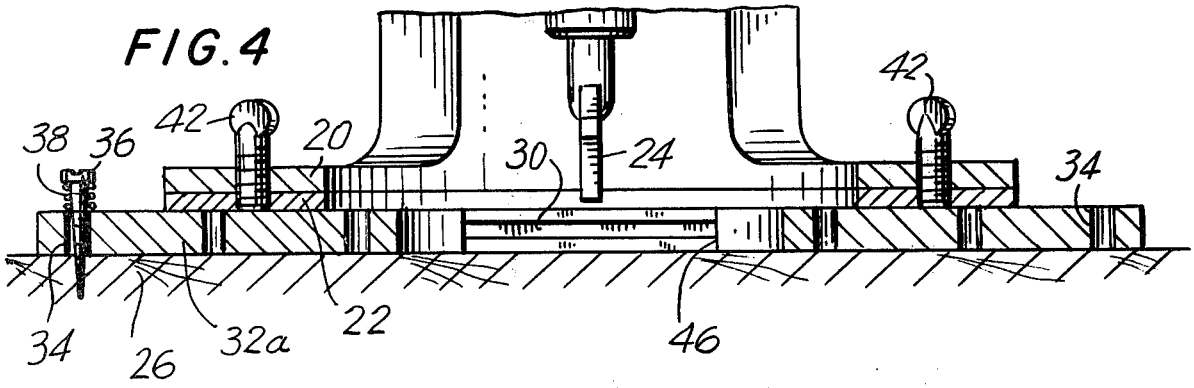
FIG. 4 is a sectional view taken along the line 4—4 of FIG. 3 and showing particularly the fixed adjustment of the router base plate slides by means of set screws, and the use of the pilot pin to anchor the tool during use.
Figure 5:
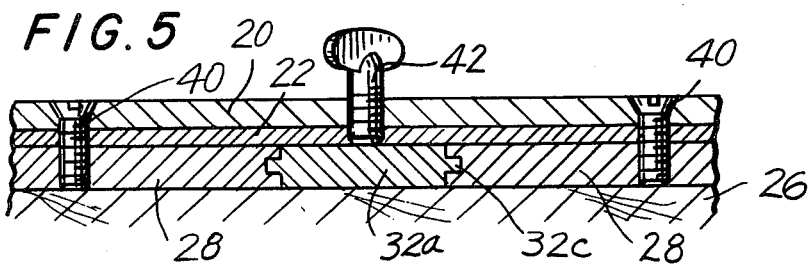
FIG. 5 is another sectional view taken along the line 5—5 of FIG. 3 and showing particularly the use of the set screw and the affixing of the base plate to the router frame.

If the operator desires to make a cut with a radius larger than the distance between the outer extent of annular base 20 and the center of cutting tool 24, he simply moves slide 32*a* (FIG. 3) left-wardly in the direction of arrow 48 until the radius of the curve desired equals the distance between the position of pilot pin 36 and the center of cutting tool 24, as shown in FIG. 3. Winged set screw 42 is then tightened until slide 32*a* is secured. The router is then moved in directions depicted by arrow 50 so that the cut is made in work piece 26. Other phases of this operation are shown in FIGS. 4 and 5 wherein the insertion of pilot pin 36 through positioning openings 34 and the clamping of slide 32*a* by set screw 42 are illustrated.

Figure 7:
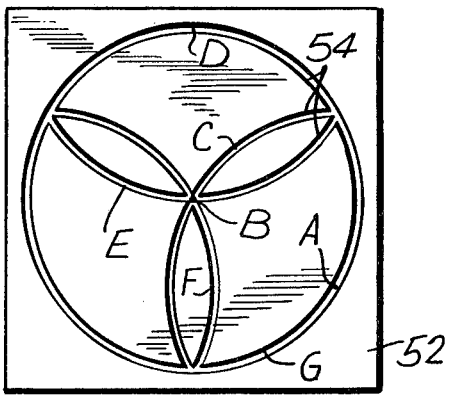
FIGS. 7, 8, 9, 10, 11A, 11B, 12A and 12B are illustrations of the routing or cutting capability of a router according to the present invention.
Figure 8:
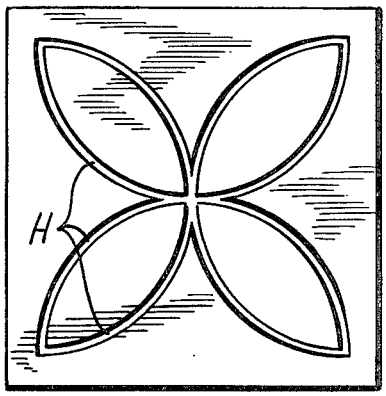
Figure 9:
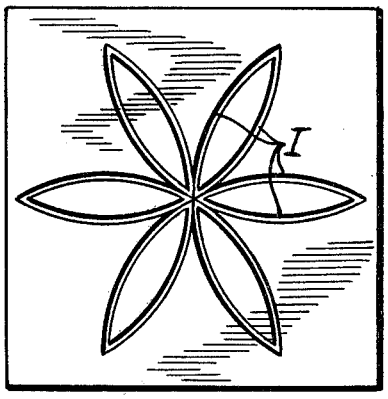

Referring now to FIGS. 7 through 12B, a number of series of operational steps will now be described in order to illustrate fully the capability of the construction. For instance, FIG. 7 shows a design essentially carved into wood 52 by use of a router according to the present invention. Specifically, double lines 54 represent grooves cut into wood 52 by cutting tool 24. An example of an operation to produce the FIG. 7 design would be to first extend slide 32*b* of FIG. 3 so that its outermost positioning opening 34*a* is separated from cutting tool 24 by an amount equal to the distance between points A and B on FIG. 7. Set screw 42*a* of FIG. 3 is then tightened down upon slide 32*b* to hold the position of that slide. Pilot pin 36 is then inserted through opening 34*a* and pressed into the wood 52 at point A. The router is then turned on by use of switch 14 (FIG. 1) and curve C routed out.

Figure 10:
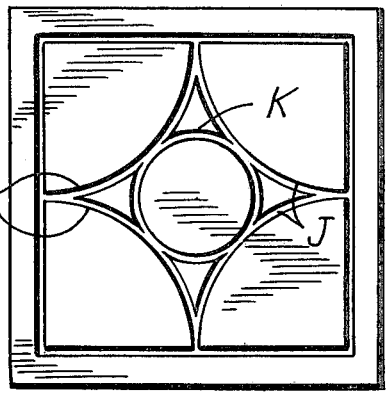

Of course, slide 32*a* of FIG. 3 can be moved out by the same amount as described above for slide 32*b* and a second pilot pin placed in its outermost position opening so that when the next curve of FIG. 7 is to be routed, the operator need not turn the tool. The operator can simply move the tool so that the second pilot pin is placed at point D at FIG. 7 to scribe the arc E shown in that drawing. In this respect, the use of coiled springs 38 with the pilot pins enables use of both slides in one operation. More specifically, if the spring 38 is affixed to the pilot pin 36, it can be quickly used to raise one pilot pin from the work piece while the other is in use. In like manner, the arcs F and G of FIG. 7 may be cut without constant turning of the router tool during the operation and without any significant manipulation of various tool parts and attachments. Furthermore, it may be seen that the various arcs H of FIG. 8, I of FIG. 9 and J of FIG. 10 may be accomplished. FIG. 10 is particularly noteworthy in that circle K is obviously of a different diameter than the other curves of the work piece shown. In order to accomplish circle K, slides 32*a*, 32*b* are quickly and efficiently readjusted to a smaller diameter capability after curves J are cut by merely moving such slides toward cutting tool 24 and readjusting set screws 42.

In all operations, positioning openings 34 may or may not be used to hold set screws 42, if such screws are made of a suitable diameter to fit in such openings.

Figure 11A:
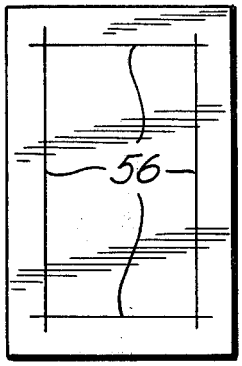
Figure 11B:
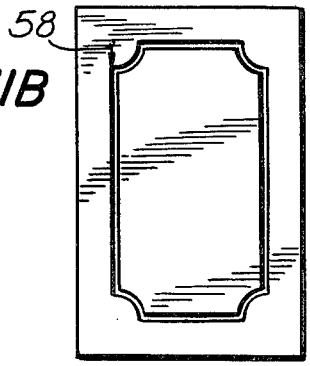
Figure 12A:
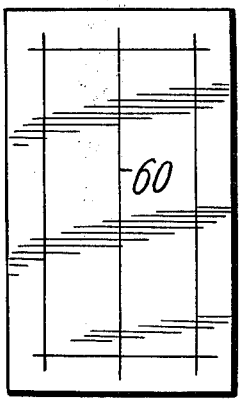
Figure 12B:
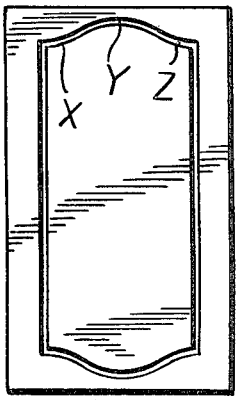

A particular capability of the present invention may be illustrated by reference to FIGS. 11A and 11B. FIG. 11A shows the work material marked with lines 56. The cut is begun on the left border with slides 32*a*, 32*b* in a position to produce curves having a radius equal to that noted in corners of FIG. 11B and designated by reference numeral 58. By following the left border from bottom to top with one pilot pin leading the tool on that path, the leading pilot pin 36 is depressed into the work piece when it reaches the intersection of the left and top border lines. The router is then routed counter-clockwise until it touches the upper border, at which time the depressed pilot pin is released and the other pilot pin is then at the leading edge of the tool as it proceeds to cut from left to right along the top border. The second pilot pin is depressed when it reaches the intersection between the top border line and the right border line, at which time it is depressed into the work piece and the router again routed counter-clockwise. The cut is continued in this manner until the design of FIG. 11B is produced. Another capability of the present invention is illustrated with respect to FIGS. 12A, 12B. The work material is marked as shown in FIG. 12A, which is similar to the marks of FIG. 11A with the addition of a center line 60. Again, the router is adjusted with its slides extended to produce a distance between the pilot pin and the cutting tool 24, which equals the radius of curves at the top and bottom of the design shown in FIG. 12A. One of the pilot pins leads the router as it travels from bottom to top on the left border line. When the leading pilot pin reaches the intersection of the left border line and the top border line, it is depressed and the router tool routed counter-clockwise to produce the curve segment X shown on FIG. 12B. When the other pilot pin reaches the center line 60 as the router cuts curve X, the first pilot pin is released and the other pilot pin depressed on to the center line, with the router routed clockwise to produce curve Y of FIG. 12B. When the first pilot pin reaches the next intersection (the top borderline and right side border line), the other pilot pin is released and the pilot pin at the intersection depressed. With the router routed counter-clockwise, curve Z is produced. The right side cut of FIG. 12B and the bottom curves thereof are produced in the same manner as just described.

It may be seen that the router tool of the present invention has capabilities in terms of ease of operation and otherwise accomplishment of its functions which has heretofore not been realized.

What is claimed is:

1. A substantially cylindrical router tool construction for use in cutting a workpiece and having an axially disposed cutting tool, comprising a motor, a motor housing, a base frame depending from said motor housing and terminating at its lower end in an annular base, to which is fixedly attached an annularly shaped router base plate, defining a center slot, and including a pair of slides for mating engagement with said slot, each slide defining a plurality of positioning openings for receiving a pilot pin to hold the router tool to a center point in the workpiece to cut an arc therein with said cutting tool.

2. The invention according to claim 1 wherein a pair of set screws are provided to hold said slides in a predetermined position depending on the radius of the arc to be cut.

3. The invention according to claim 2 wherein said annular base defines openings through which said set screws are disposed for holding said slides.

4. The invention according to claim 1 wherein said slot defines a key-way and said slides include laterally extending flanges for mating and sliding relation to said slot.

5. The invention according to claim 1 wherein said slides together define a central opening through which said cutting tool extends to said workpiece.

6. The invention according to claim 1 wherein said pilot pin is provided with coiled springs.

* * * * *